US011472047B2

(12) United States Patent
De Haas et al.

(10) Patent No.: US 11,472,047 B2
(45) Date of Patent: Oct. 18, 2022

(54) CUTTING ASSEMBLY AND TRIMMER COMPRISING THE SAME

(71) Applicant: KONINKLIJKE PHILIPS N.V., Eindhoven (NL)

(72) Inventors: Rogier Enrico De Haas, Hilversum (NL); Martinus Bernardus Stapelbroek, Frieschepalen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/277,319

(22) PCT Filed: Sep. 27, 2019

(86) PCT No.: PCT/EP2019/076264
§ 371 (c)(1),
(2) Date: Mar. 18, 2021

(87) PCT Pub. No.: WO2020/070019
PCT Pub. Date: Apr. 9, 2020

(65) Prior Publication Data

US 2021/0347068 A1 Nov. 11, 2021

(30) Foreign Application Priority Data

Oct. 2, 2018 (EP) ..... 18198137

(51) Int. Cl.
*B26B 19/12* (2006.01)
*B26B 19/04* (2006.01)

(52) U.S. Cl.
CPC ..... *B26B 19/12* (2013.01); *B26B 19/042* (2013.01); *B26B 19/044* (2013.01)

(58) Field of Classification Search
CPC ... B26B 19/042; B26B 19/044; B26B 19/046; B26B 19/12; B26B 19/06; B26B 19/063; B26B 19/10; B26B 19/38; B26B 19/3846
(Continued)

(56) References Cited

U.S. PATENT DOCUMENTS 2,206,551 A * 7/1940 Muros ..... B26B 19/042 30/43.92
2,251,577 A 8/1941 Rand
(Continued)

FOREIGN PATENT DOCUMENTS

DE 102009035232 2/2011
EP 3002094 4/2016
(Continued)

OTHER PUBLICATIONS

International Search Report and Written Opinion dated Nov. 4, 2019 for International Application No. PCT/EP2019/076264 Filed Sep. 27, 2019.

*Primary Examiner* — Phong H Nguyen

(57) ABSTRACT

Provided is a cutting assembly (100) for cutting hairs on skin. The cutting assembly comprises a guard plate (102) for contacting the skin. The guard plate has a first toothed edge (104A) which extends along an axis. The first toothed edge comprises guard teeth (106A). The cutting assembly further comprises a cutter plate (108) which is disposed on the guard plate. The cutter plate is slidable relative to the guard plate in directions parallel with the axis. The cutter plate comprises a second toothed edge (110A) extending parallel with the axis. The second toothed edge comprises cutting teeth (112A). The cutter plate and the guard plate are aligned such that the hairs are cut by the cutting teeth against the guard teeth when the cutter plate slides. The cutting teeth each include a cutting portion (114A) and a tip (116A). The tip is outwardly enlarged relative to the cutting portion in at least
(Continued)

one direction parallel with the axis. The minimum space between adjacent tips is less than the minimum space between adjacent guard teeth. The tip thereby maintains overlap with at least one of the guard teeth during sliding of the cutter plate relative to the guard plate. Further provided is a trimmer including the cutting assembly.

20 Claims, 2 Drawing Sheets

(58) Field of Classification Search
USPC ..... 30/43.91, 43.7, 43.8, 43.9, 43.92
See application file for complete search history.

(56) References Cited

U.S. PATENT DOCUMENTS 3,538,693 A 11/1970 Hast
4,118,863 A * 10/1978 Sandy ..... B26B 19/20
30/195
5,802,932 A 9/1998 Vankov
8,186,064 B2 * 5/2012 Pragt ..... B26B 19/06
30/43.92
2009/0320296 A1 * 12/2009 Morisugi ..... B26B 19/3846
30/43.92
2012/0240409 A1 * 9/2012 Inoue ..... B26B 19/06
30/43.92
2016/0236362 A1 * 8/2016 Stapelbroek ..... B26B 19/06
2018/0009121 A1 * 1/2018 Stapelbroek ..... B26B 19/3893

FOREIGN PATENT DOCUMENTS

EP 3360656 8/2018
WO 2016/134979 9/2016

* cited by examiner

CUTTING ASSEMBLY AND TRIMMER COMPRISING THE SAME

CROSS REFERENCE TO RELATED APPLICATIONS

This application is the U.S. National Phase application under 35 U.S.C. § 371 of International Application No. PCT/EP2019/076264 filed Sep. 27, 2019, which claims the benefit of European Patent Application Number 18198137.4 filed Oct. 2, 2018. These applications are hereby incorporated by reference herein.

FIELD OF THE INVENTION

This invention relates to a cutting assembly and a trimmer comprising the same.

BACKGROUND OF THE INVENTION

Various types of trimmers are known for cutting hair. One such type is the so-called reciprocating trimmer, which has a stationary guard plate which contacts the skin, and a moveable cutter plate which slides to and fro, i.e. in a reciprocating manner, on the guard plate. The guard plate and the cutter plate both have toothed edges. The teeth of the cutter plate cut hairs against the teeth of the guard plate as the cutter plate slides relative to the guard plate.

It is noted that U.S. Pat. No. 5,802,932 discloses a method for manufacturing a blade for a reciprocating trimmer. In this method a sheet of hardened steel comprising the cutter teeth is welded to wall portions of softer metal. U.S. Pat. No. 5,802,932 further discloses that the teeth of the blade might be of different lengths.

As well as protecting the user from the cutter plate and providing teeth against which the cutter plate cuts hair, the guard plate lends structural robustness to the cutter plate-guard plate cutting assembly as a whole. In, for instance, the "OneBlade" reciprocating trimmer from Philips, the metallic guard plate, together with a plastic frame around the guard plate, provides the cutting assembly with the requisite mechanical rigidity.

It would be desirable to make the guard plate as thin as possible to enable the trimmer to achieve a closer cut. This is because the thickness of the guard plate is a limiting factor in determining how short hairs can be trimmed. However, as the thickness of the guard plate decreases, so does its stiffness. A decreased stiffness of the guard plate may compromise the robustness of the overall cutting assembly. In particular, a thinner guard plate may detriment the ability of the guard plate and its teeth to withstand the cutting forces to which they are subjected, such that the guard plate bends or deforms to an undesirable extent during cutting. This may cause damage to the cutting assembly, and also risks damaging the skin of the user.

SUMMARY OF THE INVENTION

The invention is defined by the claims.

According to an aspect there is provided a cutting assembly for cutting hairs on skin, the cutting assembly comprising: a guard plate for contacting the skin, the guard plate having a first toothed edge extending along an axis and comprising guard teeth; and a cutter plate disposed on the guard plate, which cutter plate is slidable relative to the guard plate along the axis, the cutter plate comprising a second toothed edge extending parallel with the axis and comprising cutting teeth, the cutter plate and the guard plate being arranged such that the hairs are cut by the cutting teeth against the guard teeth when the cutter plate slides, wherein the cutting teeth each include a cutting portion and a tip, which tip is outwardly enlarged relative to the cutting portion in at least one direction parallel with the axis, and wherein the minimum space between adjacent tips is less than the minimum space between adjacent guard teeth, each tip maintaining overlap with at least one of the guard teeth as the cutter plate slides.

The present invention is based on the realization that the cutting teeth of the cutter plate may be used to add mechanical rigidity to the cutting assembly, particularly at the (first) toothed edge of the guard plate which is subjected to significant forces during cutting. The cutting teeth each include a cutting portion and a tip. The tip is enlarged outwardly relative to the cutting portion such that the minimum space between adjacent tips is less than the minimum space between adjacent guard teeth. Thus, the outward enlargement of the tip is such that the tip and at least one guard tooth maintain overlap, at least partially, with each other during the sliding of the cutter plate relative to the guard plate. This means that the cutting teeth provide greater mechanical support to the guard teeth, and the guard plate, throughout the cutting motion. This additional mechanical rigidity provided by the cutting teeth may permit the guard plate to be made thinner, so as to attain a closer cut, but with less risk of compromising the mechanical integrity of the cutting assembly.

The tips of the cutting teeth and the guard teeth may be arranged such that gaps are provided therebetween during the sliding. Such gaps may facilitate receiving of hairs between the cutting teeth and the guard teeth. When the cutting assembly is moved in a direction which is substantially perpendicular to the axis along which the first toothed edge extends, hairs may access the cutting portion of the cutting teeth via the gaps. In spite of the provision of such gaps for hair entry, the tips of the cutting teeth still ensure that mechanical support is provided to the guard teeth, and the guard plate, throughout the cutting motion.

The tip may be outwardly enlarged relative to the cutting portion in both directions parallel with the axis. The tip may, for example, partially overlap with each guard tooth of a pair of neighbouring guard teeth when the cutting portion is between the pair.

In this manner, a single cutting tooth may support the pair of neighbouring guard teeth when the cutting tooth is between, e.g. midway between, the pair of neighbouring guard teeth.

The outward enlargement of the tip from the cutting portion in one direction parallel may exceed 50 μm. The tip may thus protrude beyond the breadth of a hair, which may measure between 50 μm and 250 μm, in the direction parallel with the first and second toothed edges. The hair may thus be prevented by the tip from escaping from the cutting portion of the cutting tooth, so as to promote cutting of the hair by the cutting portion. The cutting portion is located more centrally in the cutting assembly than the tip, and thus hair being cut at the cutting portion may result in less risk of deformation of the guard plate and the cutting assembly as a whole, i.e. because the mechanical rigidity of the cutting assembly may be greater in more central regions than at the tips of the cutting teeth. By promoting cutting at the cutting portions rather than at the tips of the cutting teeth in this manner, the mechanical demands on the guard teeth and guard plate may be reduced, such that a thinner guard plate may be employed.

The tip may have a shape which bulges outwardly from the cutting portion. Such a shape, e.g. a bulbous shape, for the tips may assist to guide the hair towards the cutting portions, where cutting may be less liable to deform the guard teeth. The tips having such a shape may also have a beneficial effect on skin doming, which is the deformation of the skin through the gaps between the guard teeth, and thus may enhance the closeness of the cut provided by the cutting assembly.

The cutting portion may comprise a cutting edge, and the tip may comprise a guiding edge which is less sharp than the cutting edge. The guiding edge of the tip being blunt relative to the cutting edge of the cutting portion may assist the tip to guide the hair towards the cutting portion, rather than the tip itself effecting cutting of the hair. Cutting the hair with the cutting portion rather than with the tip makes for less mechanical demand being placed on the guard teeth, which may enable a thinner guard plate to be used, as previously described.

In an embodiment, an outer surface of the tip includes a flat portion which opposes the cutting portion. The flat portion may have a beneficial effect on skin doming, and thus may enhance the closeness of the cut provided by the cutting assembly.

The guard plate may comprise a further first toothed edge opposing the first toothed edge, which further first toothed edge comprises further guard teeth, and the cutter plate comprises a further second toothed edge opposing the second toothed edge, which further second toothed edge comprises further cutting teeth, wherein the hairs are cut by the further cutting teeth against the further guard teeth when the cutter plate slides. In this embodiment, the cutting assembly may be regarded as a dual-sided blade, which may enhance hair cutting efficiency.

The further cutting teeth may each include a further cutting portion and a further tip, which further tip is outwardly enlarged relative to the further cutting portion in at least one direction parallel with the axis, wherein the minimum space between adjacent further tips is less than the minimum space between adjacent further guard teeth, each further tip maintaining overlap with at least one of the further guard teeth as the cutter plate slides. In this way, both the cutting teeth and the further cutting teeth may contribute to the mechanical rigidity of the cutting assembly as a whole.

The further tips of the further cutting teeth and the further guard teeth may be arranged such that further gaps are provided therebetween during the sliding. The further gaps facilitate receiving of hairs between the further cutting teeth and the further guard teeth.

The further tip may be outwardly enlarged relative to the further cutting portion in both directions parallel with the axis. The further tip may, for example, partially overlap with each further guard tooth of a pair of neighbouring further guard teeth when the further cutting portion is between the pair of neighbouring further guard teeth.

The outward enlargement of the further tip from the further cutting portion in one direction parallel with the axis may exceed 50 μm. The further tip may thus protrude beyond the breadth of a hair, such as to prevent such a hair from escaping from the further cutting portion of the further cutting tooth. This may promote cutting of the hair by the further cutting portion, so as to reduce the mechanical demands on the further guard teeth and guard plate.

The further tip may have a shape which bulges outwardly from the further cutting portion. Such a shape, e.g. a bulbous shape, for the further tips may assist to guide the hair towards the further cutting portions, where cutting may be less liable to deform the further guard teeth. The further tips having such a shape may also have a beneficial effect on skin doming and thus may enhance the closeness of the cut provided by the cutting assembly.

The further cutting portion may comprise a further cutting edge, and the further tip may comprise a further guiding edge which is less sharp than the further cutting edge. Accordingly, the further tip may guide the hair towards the further cutting portion, rather than the further tip itself cutting the hair.

The first toothed edge and the second toothed edge may be arranged in a step-like manner, with the first toothed edge protruding beyond the second toothed edge. When the cutting assembly includes the further first toothed edge (104B) and the further second toothed edge (110B), the further first toothed edge and the further second toothed edge may be arranged in a step-like manner, with the further first toothed edge protruding beyond the further second toothed edge.

By the first toothed edge protruding beyond the second toothed edge, the protection provided by the guard plate to the user may be enhanced, e.g. relative to the scenario where the first toothed edge aligns flush with the second toothed edge. The same applies when the further first toothed edge protrudes beyond the further second toothed edge.

According to another aspect there is provided a trimmer for cutting hair, the trimmer comprising: a cutting assembly as defined above; a body; and a drive mechanism housed in the body, the drive mechanism being adapted to engage with the cutter plate and drive the sliding of the cutter plate to and fro relative to the guard plate.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
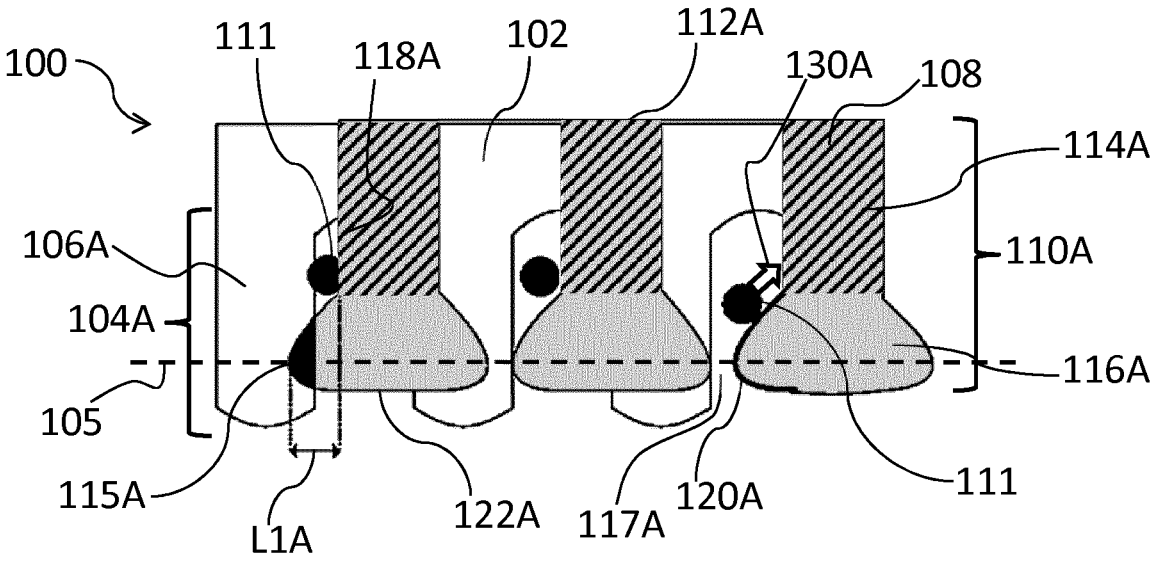
FIG. 1 shows a portion of a cutting assembly according to an embodiment.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

Provided is a cutting assembly for cutting hairs on skin. The cutting assembly comprises a guard plate for contacting the skin. The guard plate has a first toothed edge which extends along an axis. The first toothed edge comprises guard teeth. The cutting assembly further comprises a cutter plate which is disposed on the guard plate. The cutter plate is slidable relative to the guard plate in directions parallel with the axis. The cutter plate comprises a second toothed edge extending parallel with the axis. The second toothed edge comprises cutting teeth. The cutter plate and the guard plate are aligned such that the hairs are cut by the cutting teeth against the guard teeth when the cutter plate slides. The cutting teeth each include a cutting portion and a tip. The tip is outwardly enlarged relative to the cutting portion in at least one direction parallel with the axis. The minimum space between adjacent tips is less than the minimum space between adjacent guard teeth. The tip thereby maintains overlap with at least one of the guard teeth during sliding of the cutter plate relative to the guard plate.

The present invention is based on the realization that the cutting teeth of the cutter plate may be used to add mechanical rigidity to the cutting assembly, particularly at the (first) toothed edge of the guard plate which is subjected to significant forces during cutting. The cutting teeth each include a cutting portion and a tip. The tip is enlarged outwardly relative to the cutting portion such that the minimum space between adjacent tips is less than the minimum space between adjacent guard teeth. Thus, the outward enlargement of the tip is such that the tip and at least one guard tooth maintain overlap, at least partially, with each other during the sliding of the cutter plate relative to the guard plate. This means that the cutting teeth provide greater mechanical support to the guard teeth, and the guard plate, throughout the cutting motion. This additional mechanical rigidity provided by the cutting teeth may permit the guard plate to be made thinner, so as to attain a closer cut, but with less risk of compromising the mechanical integrity of the cutting assembly.

FIG. 1 schematically depicts a portion of a cutting assembly 100 according to an embodiment. The cutting assembly 100 comprises a guard plate 102. The guard plate 102 includes a first toothed edge 104A, which first toothed edge 104A extends along a notional axis 105. The first toothed edge 104A comprises an array of guard teeth 106A.

The guard plate 102 contacts the skin (not shown) during hair cutting, and protects the skin from the cutter plate 108, which slides to and fro, i.e. in a reciprocating manner, on the guard plate 102. The guard plate 102 may therefore be made of a material which is capable of protecting the user from the reciprocating cutter plate 108, such as a metal or metal alloy, e.g. stainless steel. Moreover, the cutting assembly 100 may, for example, include a frame (not shown) around the guard plate 102 for providing additional protection, as well as enhanced mechanical rigidity. In this respect, the frame may, for instance, be formed from a plastic, metal or metal alloy, e.g. stainless steel. Preferably, a plastic is used for the frame to keep the cutting assembly 100 relatively light-weight, and to save on manufacturing costs.

The cutter plate 108 comprises a second toothed edge 110A. The second toothed edge 110A comprises cutting teeth 112A. The first toothed edge 104A and the second toothed edge 110A are arranged relative to each other such that hairs 111 are cut by the cutting teeth 112A against the guard teeth 106A during sliding of the cutter plate 108 along the axis 105. As shown in FIG. 1, hairs 111 are received between the cutting teeth 112A and the guard teeth 106A, and are ultimately cut when the cutter plate 108 slides to a sufficient degree to cut the hairs 111 between the respective teeth. To this end, the cutting teeth 112A may include a cutting edge 118A which acts as a blade to cut the hairs 111.

The cutter plate 108 may be made of a material capable of withstanding the cutting forces to which the cutter plate 108 is subjected, together with the guard plate 102, during cutting. The cutter plate 108 may, for instance, include a metal or metal alloy, such as stainless steel.

As shown in FIG. 1, the cutting teeth 112A each include a cutting portion 114A and a tip 116A. The cutting portion 114A corresponds to the area of diagonal line hatching in FIG. 1. The tip 116A is outwardly enlarged relative to the cutting portion 114A in both directions parallel with the axis 105 defined by the first toothed edge 104A. As schematically depicted in FIG. 1, the tip 116A thus maintains overlap 115A with at least one of the guard teeth 106A during the reciprocating cutting motion of the cutter plate 108.

This overlap results because the minimum space between the enlarged tips 116A is smaller than the minimum space between the guard teeth 106A. For example, the minimum space between the enlarged tips 116A is 10% to 50% of the minimum space between the guard teeth 106A.

Furthermore, the pitch of the cutting teeth 112A may be different to the pitch of the guard teeth 106A so that the overlap may be distributed across the length of the cutting assembly 100, i.e. along the axis 105. This difference in the respective pitches of the guard teeth 106A and the cutting teeth 112A may prevent that too many hairs are cut at the same time by the cutting assembly 100, and therefore reduces the load on the drive mechanism (not shown in FIG. 1) of a trimmer employing the cutting assembly 100.

This means that the cutting teeth 112A provide greater mechanical support to the guard teeth 106A, and the guard plate 102, throughout the cutting motion. This additional mechanical rigidity provided by the cutting teeth 112A may permit the guard plate 102 to be made thinner, so as to attain a closer cut, but with less risk of compromising the mechanical integrity of the cutting assembly 100.

Whilst the outward enlargement of the tip 116A shown in FIG. 1 is in both directions parallel with the axis 105, it is also contemplated that the tip 116A may, for instance, be enlarged in only one direction, providing that overlap with at least one of the guard teeth 106A is maintained as the cutter plate 108 slides.

In the embodiment shown in FIG. 1, the tip 116A partially overlaps with each guard tooth 106A of a pair of neighbouring guard teeth when the cutting portion 114A is between the pair. Such overlap is evident for the cutting tooth 112A on the far left of the portion of the cutting assembly 100 shown in FIG. 1. A single cutting tooth 112A may thus support the pair of neighbouring guard teeth 106A when the cutting tooth 112A is between, e.g. midway between, the pair of neighbouring guard teeth 106A. The fraction of each guard tooth of the pair which is overlapped by the tip when the cutting tooth 112A is midway between the pair may be, for example, between 10% and 50%.

As shown in FIG. 1, the tips 116A and the guard teeth 106A are arranged such that gaps 117A are provided therebetween during the sliding. Such gaps 117A may facilitate receiving of hairs 111 between the cutting teeth 112A and the guard teeth 106A. When the cutting assembly 100 is moved in a direction which is substantially perpendicular to the axis 105, hairs 111 may access the cutting portion 114A of the cutting teeth 112A via the gaps 117A. The gaps 117A are therefore desirable, and this preference for such gaps in conventional cutting assembly designs has hitherto dissuaded consideration of design features which might be regarded as impinging on the provision or breadth of such gaps. The inventors have found, on the contrary, that gaps 117A may be provided in addition to the outwardly enlarged tips 116A. The effective cutting associated with the provision of the gaps 117A may thus be combined with the greater mechanical support provided by the outwardly enlarged tips 116A, as previously described.

As shown in FIG. 1, the tips 116A have a bulbous shape which bulges outwardly from the cutting portions 114A. Such a bulbous shape for the tips 116A may assist to guide the hair 111 towards the cutting portions 114A, where cutting may be less liable to deform the guard teeth 106A. The tips 116A having such a bulbous shape may also have a beneficial effect on skin doming, which is the deformation of the skin through the gaps between the guard teeth, and thus may enhance the closeness of the cut provided by the cutting assembly 100.

Skin doming may be further assisted by the flat portion 122A on an outer surface of the tip 116A, which flat portion 122A opposes the cutting portion 114A. The enlarged shape of the tip 116A area may be optimized for skin friendliness and skin doming control. The skin doming during hair cutting may thus be controlled using the cutting assembly 100 from all sides of the hair, which may enable a closer cut.

As previously noted, the cutting portion 114A of the cutting assembly 100 shown in FIG. 1 includes a cutting edge 118A which is a relatively sharp edge for cutting hair 111 against a respective guard tooth 106A. Moreover, the tip 116A may comprise a guiding edge 120A which is less sharp than the cutting edge 118A.

The guiding edge 120A of the tip 116A being blunt relative to the cutting edge 118A of the cutting portion 114A may assist the tip 116A to guide the hair 111 towards the cutting portion 114A, rather than the tip 116A itself effecting cutting of the hair 111. This is schematically depicted in FIG. 1 by the hair 111 furthest towards the right hand side of the cutting assembly 100 being moved by the guiding edge 120A towards the cutting portion 114A, rather than being cut by the tip 116A. The arrow 130A shows the direction in which the hair 111 is guided by the tip 116A, i.e. towards the cutting portion 114A. The guiding edge 120A curves towards the point at which the tip 116A and the cutting portion 114A adjoin. The guiding edge 120A thus assists to transport the hair 111 in the direction shown by the arrow 130A. Once moved by the tip 116A, the hair 111 is then cut by the cutting edge 118A of the cutting portion 114A, as schematically depicted on the left hand side of the cutting assembly 100 shown in FIG. 1.

The cutting portion 114A may be regarded as being located more centrally in the cutting assembly 100 than the tip 116A, and thus hair being cut at the cutting portion 114A may result in less risk of deformation of the guard teeth 106A, the guard plate 102 and the cutting assembly 100 as a whole. This may be due to the mechanical rigidity of the cutting assembly 100 being greater in more central regions than at the tips 116A of the cutting teeth 112A. By promoting cutting at the cutting portions 114A rather than at the tips 116A of the cutting teeth 112A in this manner, the mechanical demands on the guard teeth 106A and guard plate 102 may be reduced, such that a thinner guard plate 102 may be employed. A thinner guard plate 102 may result in a closer cut, as previously described.

In an embodiment, the outward enlargement L1A of the tip 116A from the cutting portion 114A in one direction parallel with the axis 105 exceeds 50 μm. The outward enlargement L1A may thus be larger than the breadth of a hair 111. Moreover, the spaces between adjacent guard teeth 106A may, for example, measure between 100 μm and 500 μm, thereby to enable hairs to pass into the spaces between the guard teeth 106A.

As shown in FIG. 1, once guided towards the cutting portion 114A by the tip 116A, the hair 111 may be prevented by the tip 116A from escaping from the cutting portion 114A of the cutting tooth 112A, so as to promote cutting of the hair 111 by the cutting portion 114A. Cutting the hair 111 with the cutting portion 114A rather than with the tip 116A makes for less mechanical demand being placed on the guard teeth 106A and the guard plate 102, which may enable a thinner guard plate 102 to be used, as previously described.

Figure 2:
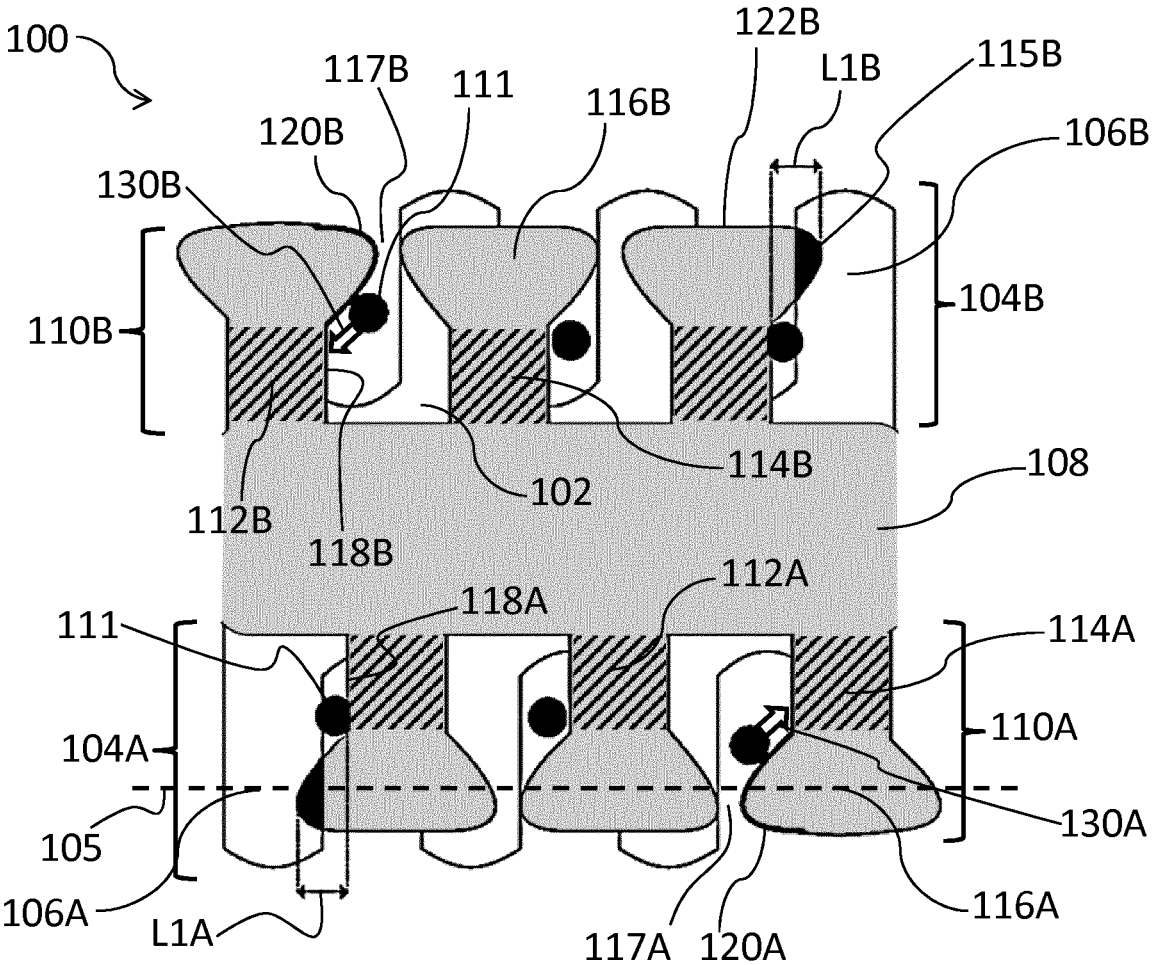
FIG. 2 shows a portion of a cutting assembly according to another embodiment.

Turning to FIG. 2, a portion of a cutting assembly 100 according to another embodiment is schematically depicted. The guard plate 102 shown in FIG. 2 comprises a further first toothed edge 104B opposing the first toothed edge 104A. The further first toothed edge 104B comprises further guard teeth 106B. The cutter plate 108 comprises a further second toothed edge 110B opposing the second toothed edge 110A. The further second toothed edge 110B comprises further cutting teeth 112B. As described above in relation to the first toothed edge 104A and the second toothed edge 110A, hairs 111 are cut by the further cutting teeth 112B against the further guard teeth 106B when the cutter plate 108 slides relative to the guard plate 102. In this embodiment, the cutting assembly 100 may be regarded as a dual-sided blade, which may enhance hair cutting efficiency.

Similarly to the case described above in relation to FIG. 1, the further cutting teeth 112B may each include a further cutting portion 114B and a further tip 116B. The further tip 116B is outwardly enlarged relative to the further cutting portion 114B in at least one direction parallel with the axis 105 defined by the first cutting edge 104A. The minimum space between adjacent further tips 116B is less than the minimum space between adjacent further guard teeth 106B. The further tip 116B thus maintains overlap 115B with at least one of the further guard teeth 106B as the cutter plate 108 slides relative to the guard plate 102. In this way, both the cutting teeth 112A and the further cutting teeth 112B may contribute to the mechanical rigidity of the cutting assembly 100 as a whole.

The further tips 116B and the further guard teeth 112B may be arranged such that further gaps 117B are provided therebetween during the sliding. The further gaps 117B facilitate receiving of hairs 111 between the further cutting teeth 112B and the further guard teeth 106B, as previously described in respect of the gaps 117A in the cutting assembly 100 shown in FIG. 1.

As shown in FIG. 2, the further tip 116B is outwardly enlarged relative to the further cutting portion 114B in both directions parallel with the axis 105, although enlargement in one direction may also be contemplated. The further tip 116B may, for example, partially overlap with each further guard tooth 106B of a pair of neighbouring further guard teeth 106B when the further cutting portion 114B is between the pair of neighbouring further guard teeth 106B.

The outward enlargement L1B of the further tip 116B from the further cutting portion 114B in one direction parallel with the axis 105 may exceed 50 μm. Moreover, the spaces between adjacent further guard teeth 106B may, for example, measure between 100 μm and 500 μm, thereby to enable hairs to pass into the spaces between the further guard teeth 106B.

The further tip 116B may thus protrude beyond the breadth of a hair 111, such as to prevent such a hair 111 from escaping from the further cutting portion 114B of the further cutting tooth 112B. This may promote cutting of the hair 111 by the further cutting portion 114B, so as to reduce the mechanical demands on the further guard teeth 106B and guard plate 102, as previously described in relation to FIG. 1.

Similarly to the tip 116A, the further tip 116B may have a bulbous shape which bulges outwardly from the further cutting portion 114B. Such a bulbous shape for the further tips 116B may assist to guide the hair 111 towards the further cutting portions 114B, where cutting may be less liable to deform the further guard teeth 106B. The further tips 116B having such a bulbous shape may also have a beneficial effect on skin doming and thus may enhance the closeness of the cut provided by the cutting assembly 100, as previously described.

Skin doming may be further assisted by the further flat portion 122B on an outer surface of the further tip 116B, which further flat portion 122B opposes the further cutting portion 114B.

Similarly to the embodiment of FIG. 1 described above, the further cutting portion 114B may comprise a further cutting edge 118B, and the further tip 116B may comprise a further guiding edge 120B which is less sharp than the further cutting edge 118B. The arrow 130B shows the direction in which the hair 111 is guided by the further tip 116B, i.e. towards the further cutting portion 114B. The further guiding edge 120B curves towards the point at which the further tip 116B and the further cutting portion 114B adjoin. The further guiding edge 120B thus assists to transport the hair 111 in the direction shown by the arrow 130B. Once moved by the further tip 116B, the hair 111 is then cut by the further cutting edge 118B of the further cutting portion 114B.

In the embodiments shown in FIGS. 1 and 2, the first toothed edge 104A and the second toothed edge 110A are arranged in a step-like manner, with the first toothed edge 104A protruding beyond the second toothed edge 110A. By the first toothed edge 104A protruding beyond the second toothed edge 110A, the protection provided by the guard plate 102 to the user may be enhanced, e.g. relative to the scenario where the first toothed edge 104A aligns flush with the second toothed edge 110A. The same applies when the further first toothed edge 104B protrudes beyond the further second toothed edge 110B, as shown in FIG. 2.

Whilst a dual-sided cutting blade 100 is shown in FIG. 2, cutting assemblies having additional operational edges, e.g. "middle-track" cutting edges located in one, two or more positions between the opposing toothed edges 104A and 104B (and 110A and 110B) described above in relation to the cutting assembly 100 shown in FIG. 2, may also be contemplated. The supplementary cutting teeth and guard teeth of such additional operational edges may be similar to the cutting teeth 112A and the guard teeth 106A described above in relation to FIGS. 1 and 2.

Figure 3:
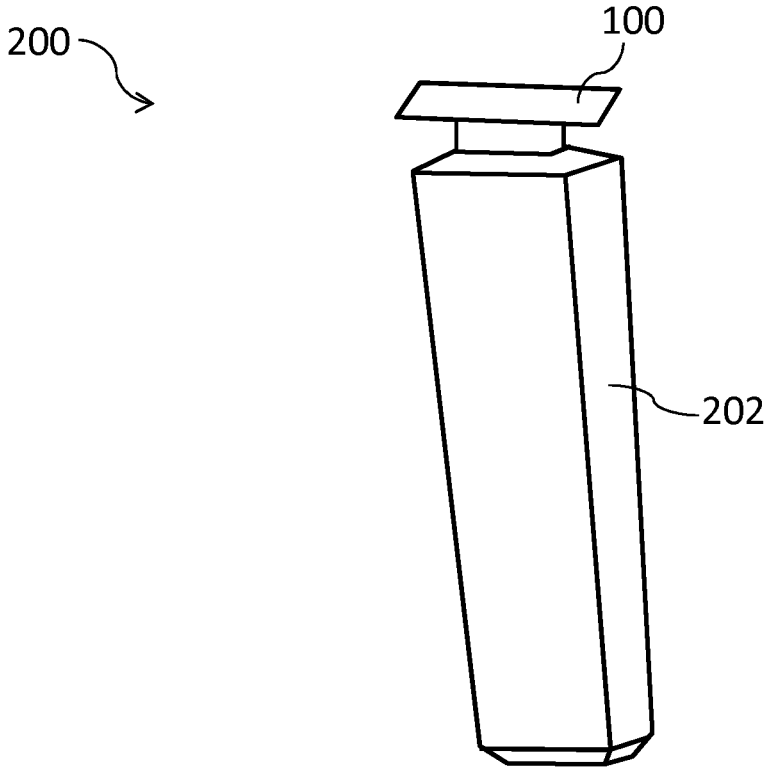
FIG. 3 shows a trimmer according to an embodiment.

FIG. 3 shows a trimmer 200 for cutting hair according to an embodiment. The trimmer 200 comprises the cutting assembly 100 as described above, which is in the form of a blade attachment which is mounted on the body 202 of the trimmer 200. The cutting assembly 100 may, for instance, be detachably mounted on the body 202, so as to enable replacement of the cutting assembly 100, if required. In another non-limiting example, the cutting assembly 100 may pivot with respect to body 202 in one or more directions, thereby enabling the trimmer 200 to respond to the contours of the skin.

The body 202 is elongated in the non-limiting example shown in FIG. 3; the body 202 further functioning as a handle for the user to grasp during hair cutting. A drive mechanism (not visible in FIG. 3) is housed in the body 202, which drive mechanism engages with the cutter plate 108 and drives the sliding of the cutter plate 108 to and fro relative to the guard plate 102. Accordingly, the trimmer 200 may, for example, include batteries housed within the body 202 for supplying power to the drive mechanism.

The trimmer 200 may, for example, include a comb attachment (not shown) detachably mounted on the guard plate. As is well-known per se, such a comb attachment may act as a spacer which determines the length of hair which is cut by the cutting assembly 100.

Figure 4:
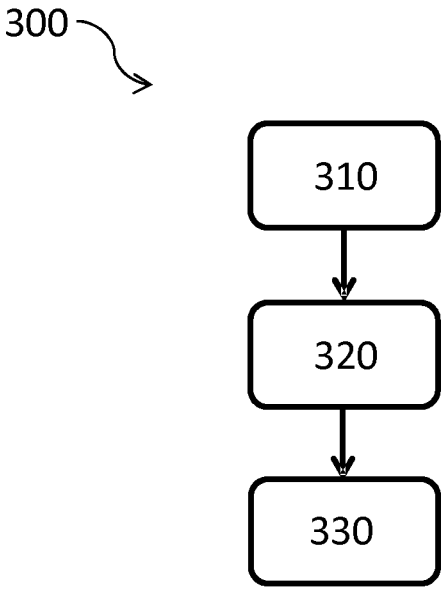
FIG. 4 shows a flowchart of a method according to an embodiment.

FIG. 4 shows a flowchart of a method 300 for cutting hairs on skin according to an embodiment. The method 300 comprises providing in step 310 a cutting assembly as previously described. In step 320, the guard plate is contacted with the skin. The cutter plate is then slid relative to the guard plate to and fro in step 330, such that said hairs are cut by the cutting teeth against the guard teeth. The tips of the cutting teeth are enlarged relative to the cutting portion such that each tip maintains at least partial overlap with at least one of the guard teeth during the sliding in step 330.

Step 330 may include using the tip to guide the hairs towards the cutting portion. Having been guided by the tip to the cutting portion, the hairs may be cut by the cutting portion against the guard teeth, as previously described.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A cutting assembly for cutting hairs on skin, the cutting assembly comprising:

a guard plate for contacting the skin, the guard plate having a first toothed edge extending along an axis and comprising guard teeth; and a cutter plate disposed on the guard plate, which cutter plate is slidable relative to the guard plate along said axis, the cutter plate comprising a second toothed edge extending parallel with said axis and comprising cutting teeth, the cutter plate and the guard plate being arranged such that said hairs are cut by the cutting teeth against the guard teeth when the cutter plate slides relative to the guard plate, wherein the cutting teeth each include a cutting portion and a tip, wherein cutting is promoted at the cutting portion rather than at the tip, which tip is outwardly enlarged relative to the cutting portion in at least one direction parallel with said axis, and wherein the minimum space between adjacent tips of respective adjacent cutting teeth of the cutter plate is less than the minimum space between corresponding adjacent guard teeth of the guard plate, each outwardly enlarged tip relative to the cutting portion of respective cutting teeth (i) maintaining overlap with at least one of said guard teeth of the guard plate and (ii) providing mechanical rigidity support, via a respective outwardly enlarged tip, at the first toothed edge throughout a cutting motion as the cutter plate slides relative to the guard plate.

2. The cutting assembly according to claim 1, wherein the tips of the cutting teeth and the guard teeth are arranged such that gaps are provided therebetween during said sliding.

3. The cutting assembly according to claim 2, wherein said tip is outwardly enlarged relative to the cutting portion in both directions parallel with said axis, and wherein the tip partially overlaps with each guard tooth of a pair of neighbouring guard teeth when the cutting portion is between said pair.

4. The cutting assembly according to claim 3, wherein the outward enlargement of the tip from the cutting portion in one direction parallel with said axis exceeds 50 μm.

5. The cutting assembly according to claim 3, wherein the tip has a shape which bulges outwardly from the cutting portion.

6. The cutting assembly according to claim 3, wherein the cutting portion comprises a cutting edge, and the tip comprises a guiding edge which is less sharp than the cutting edge.

7. The cutting assembly according to claim 3, wherein the guard plate comprises a further first toothed edge opposing the first toothed edge, which further first toothed edge comprises further guard teeth, and the cutter plate comprises a further second toothed edge opposing the second toothed edge, which further second toothed edge comprises further cutting teeth, wherein said hairs are cut by the further cutting teeth against the further guard teeth when the cutter plate slides.

8. The cutting assembly according to claim 1, wherein said tip is outwardly enlarged relative to the cutting portion in both directions parallel with said axis, and wherein the tip partially overlaps with each guard tooth of a pair of neighbouring guard teeth when the cutting portion is between said pair.

9. The cutting assembly according to claim 1, wherein the outward enlargement of the tip from the cutting portion in one direction parallel with said axis exceeds 50 μm.

10. The cutting assembly according to claim 1, wherein the tip has a shape which bulges outwardly from the cutting portion.

11. The cutting assembly according to claim 1, wherein the cutting portion comprises a cutting edge, and the tip comprises a guiding edge which is less sharp than the cutting edge.

12. The cutting assembly according to claim 1, wherein an outer surface of the tip includes a flat portion which opposes the cutting portion.

13. The cutting assembly according to claim 1, wherein the guard plate comprises a further first toothed edge opposing the first toothed edge, which further first toothed edge comprises further guard teeth, and the cutter plate comprises a further second toothed edge opposing the second toothed edge, which further second toothed edge comprises further cutting teeth, wherein said hairs are cut by the further cutting teeth against the further guard teeth when the cutter plate slides.

14. The cutting assembly according to claim 13, wherein the further cutting teeth each include a further cutting portion and a further tip, which further tip is outwardly enlarged relative to the further cutting portion in at least one direction parallel with said axis, and wherein the minimum space between adjacent further tips is less than the minimum space between adjacent further guard teeth, each further tip maintaining overlap with at least one of said further guard teeth as the cutter plate slides, and wherein the further tips of the further cutting teeth and the further guard teeth are arranged such that further gaps are provided therebetween during said sliding.

15. The cutting assembly according to claim 14, wherein said further tip is outwardly enlarged relative to the further cutting portion in both directions parallel with said axis, and wherein the further tip partially overlaps with each further guard tooth of a pair of neighbouring further guard teeth when the further cutting portion is between said pair of neighbouring further guard teeth.

16. The cutting assembly according to claim 14, wherein the outward enlargement of the further tip from the further cutting portion in one direction parallel with said axis exceeds 50 μm.

17. The cutting assembly according to claim 14, wherein the further tip has a shape which bulges outwardly from the further cutting portion.

18. The cutting assembly according to claim 14, wherein the further cutting portion comprises a further cutting edge, and the further tip comprises a further guiding edge which is less sharp than the further cutting edge.

19. The cutting assembly according to claim 13, wherein the first toothed edge and the second toothed edge are arranged in a step-like manner, with the first toothed edge protruding beyond the second toothed edge, and optionally wherein, when the cutting assembly includes the further first toothed edge and the further second toothed edge, the further first toothed edge and the further second toothed edge are arranged in a step-like manner, with the further first toothed edge protruding beyond the further second toothed edge.

20. A trimmer for cutting hair, the trimmer comprising:

a cutting assembly according to claim 1;

a body; and a drive mechanism housed in the body, the drive mechanism being adapted to engage with the cutter plate and drive said sliding of the cutter plate to and fro relative to the guard plate.

* * * * *